US005951007A

United States Patent [19]

Greive et al.

[11] Patent Number: 5,951,007

[45] Date of Patent: Sep. 14, 1999

[54] DEVICE FOR CONVEYING A SHINGLED OR IMBRICATED STREAM OF SHEETS

[75] Inventors: Maren Greive, Schönau; Heiner Luxem, Wilhelmsfeld, both of Germany

[73] Assignee: Heidelberger Druckmaschinen AG, Heidelberg, Germany

[21] Appl. No.: 08/854,373

[22] Filed: May 12, 1997

[30] Foreign Application Priority Data

May 10, 1996 [DE] Germany ..... 196 18 870

[51] Int. Cl.[6] ..... B65H 5/02

[52] U.S. Cl. ..... 271/276; 198/689.1; 271/197

[58] Field of Search ..... 198/689.1; 271/196, 271/197, 276

[56] References Cited

U.S. PATENT DOCUMENTS 3,282,586 11/1966 Schwebel ..... 271/197
5,133,543 7/1992 Eitel et al. ..... 271/197
5,288,067 2/1994 Stock ..... 198/689.1
5,531,313 7/1996 Maass ..... 198/689.1
5,697,606 12/1997 Maass ..... 198/689.1

*Primary Examiner*—Dean Kramer
*Assistant Examiner*—Gregory A. Morse
*Attorney, Agent, or Firm*—Herbert L. Lerner; Laurence A. Greenberg

[57] ABSTRACT

A device for conveying a stream, in particular an imbricated or shingled stream, of sheets to a sheet processing machine, having a conveyor table formed with suction holes, and at least one endless transport belt formed with suction holes extending therethrough and being revolvingly drivable around the conveyor table, includes at least one suction box disposed under the conveyor table and having vacuum applied thereto, the one suction box being connected, via the suction openings formed in the conveyor table, to an underside of the transport belt, the one suction box being individually assigned to the respective one endless transport belt and being formed with a single suction chamber, the one suction box having at least two suction connections spaced apart from one another, as viewed in a sheet transport direction.

9 Claims, 5 Drawing Sheets

DEVICE FOR CONVEYING A SHINGLED OR IMBRICATED STREAM OF SHEETS

BACKGROUND OF THE INVENTION

1. Field of the Invention

The invention relates to a device for conveying a stream of sheets, in particular, a shingled or imbricated stream thereof, to a sheet-processing machine, having a conveyor table formed with suction openings extending therethrough and provided with a transport belt drivable revolvingly around it, a suction box disposed under the conveyor table and having vacuum applied thereto, the suction box being connected via the suction openings formed in the conveyor table to the underside of the transport belt.

In such devices, so-called suction belt tables, there is a general problem that the first and the last sheet must also be transported reliably. The act of conveying a shingled stream of sheets on the suction belt table may be divided, in this regard, into three phases.

The first phase may be characterized by the fact that during startup of the printing machine, the first sheet, which is pushed onto the suction belt from a sheet separating or singling device, is supposed to be sucked with as little slip as possible onto the perforated transport belt. In this first phase of machine operation, however, the suction force is basically reduced so that only a given region of the transport belt is covered by the first sheet and, thus, a great amount of extraneous air is sucked in, with the result that the suction effect is limited.

In the second phase, namely the conveying of the shingled stream of sheets, which somewhat corresponds to the stationary or steady state of the system, constant operating conditions prevail, for which reason this second phase can be classified as nonproblematic.

The third phase of conveying a shingled stream of sheets relates to the conveyance of the last sheet of the shingled stream of sheets. This last sheet is sucked over the entire length thereof onto the transport belt and is thus fixed significantly more strongly on the transport belt than the partly overlapping sheets of the shingled stream of sheets. In the sheet stream, the fact that the individual sheets overlap results in the sheets being in contact only over a fraction of the area thereof with the transport belt and being consequently subjected to a reduced sucking effect. If the last sheet, during transport thereof towards the front lays, remains subjected to the vacuum prevailing in the suction belt table, the leading edge of the last sheet can be pressed against the front lays, on the one hand, or the lateral alignment can be hampered considerably, on the other hand.

The published German Patent Document DE 44 16 289 A1 has disclosed a device for conveying a sheet stream, in particular, a shingled sheet stream, to a sheet-processing machine. A suction box provided in this publication is divided by profiles, which are arranged therein, into individual suction chambers so that an effective vacuum, which is not subject to the influence of leakage, may be provided even in those regions arranged farther removed from the suction source.

SUMMARY OF THE INVENTION

It is accordingly an object of the invention to provide a device for conveying a sheet stream, in particular, a shingled or imbricated sheet stream, wherein even the first and the last sheet to be processed are transported reliably.

With the foregoing and other objects in view, there is provided, in accordance with the invention, a device for conveying a stream, in particular an imbricated or shingled stream, of sheets to a sheet processing machine, having a conveyor table formed with suction holes, and at least one endless transport belt formed with suction holes extending therethrough and being revolvingly drivable around the conveyor table, comprising at least one suction box disposed under the conveyor table and having vacuum applied thereto, the one suction box being connected, via the suction openings formed in the conveyor table, to an underside of the transport belt, the one suction box being individually assigned to the respective one endless transport belt and being formed with a single suction chamber, the one suction box having at least two suction connections spaced apart from one another, as viewed in a sheet transport direction.

In accordance with another feature of the invention, the conveying device includes at least one sheet aligning device, a forward one of the suction connections, as viewed in the sheet transport direction, facing towards the sheet-processing machine, being arranged at a distance from the aligning device corresponding at most to the format length of the smallest sheet to be processed.

In accordance with a further feature of the invention, one of the suction nozzles is disposed in a rearward region, as viewed in the sheet transport direction, facing away from the sheet processing machine, the suction nozzle being located at a distance from a sheet pile corresponding to a smallest overlap or shingle length to be processed.

In accordance with an added feature of the invention, the suction connections are subjectible to an application of vacuum, a respective one of the suction connections being switchable off.

In accordance with an additional feature of the invention, the conveying device includes a controllable air guide flap.

In accordance with yet another feature of the invention, the suction box has a cross section corresponding to the cross section of one of the suction connections.

In accordance with yet a further feature of the invention, n forward region of the suction box, as viewed in the sheet transport direction, has a suction space which is of enlarged volume and cross section than a remainder of the suction chamber.

In accordance with yet an added feature of the invention, the conveying device includes a flap pivotably arranged in the suction box for enlarging the suction space.

In accordance with a concomitant feature of the invention, the suction space enlargement is disposed at a distance from front lays which is greater than the format length of a sheet to be processed.

The advantage of the invention lies in particular in the fact that, in the case of the single-chamber suction box according to the invention, a low, space-saving constructional size can be implemented. As a result of this relatively simple, small-volume construction of a suction box assigned to each transport belt, suction sources, such as fans, for example, of low power can be employed. It is also of particular advantage that a complicated subdivision of the suction box into a plurality of chambers, arranged in succession, one after the other, as viewed in the sheet transport direction, is unnecessary.

Other features which are considered as characteristic for the invention are set forth in the appended claims.

Although the invention is illustrated and described herein as embodied in a device for conveying a shingled or imbricated stream of sheets, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figures 1, 1A:
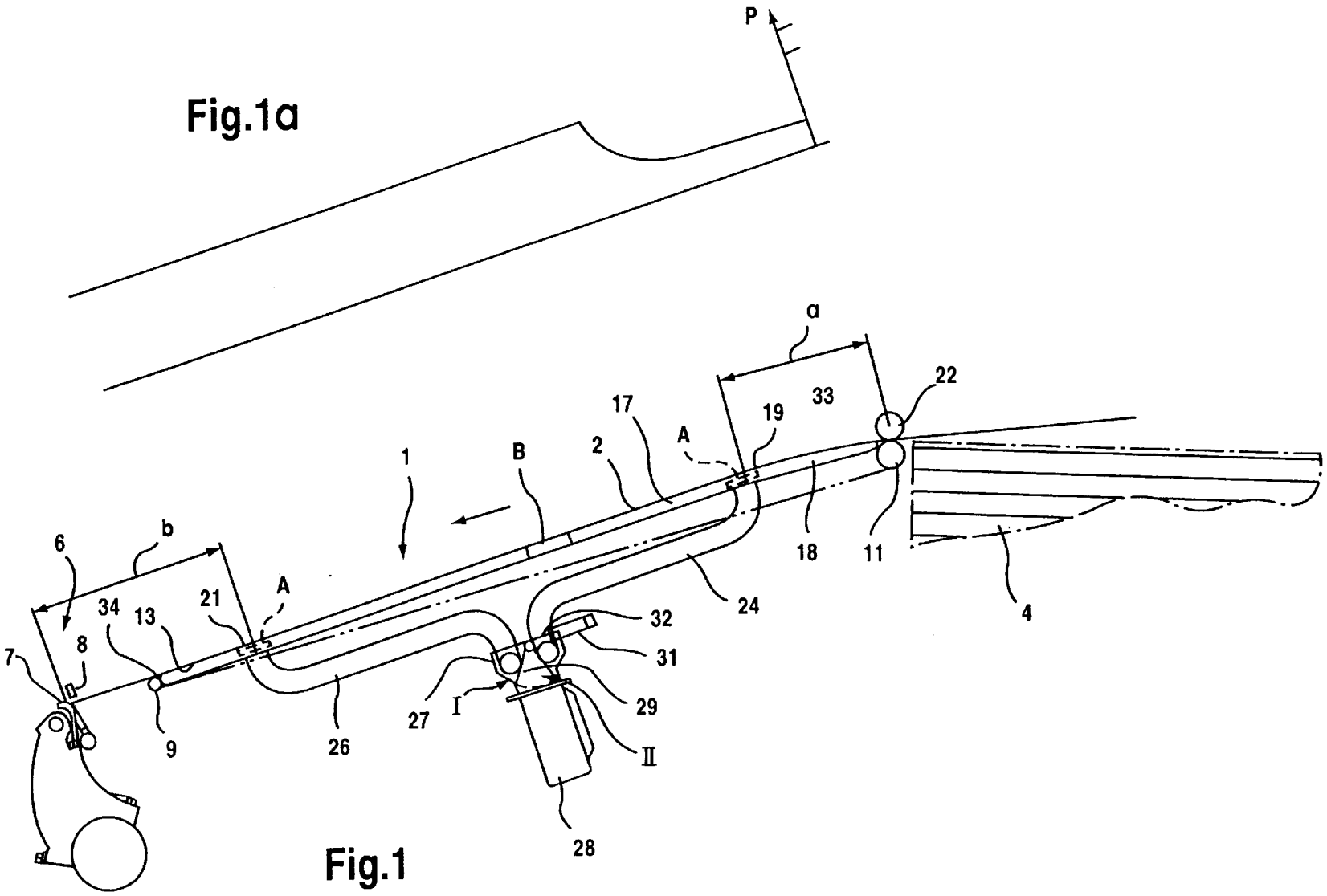
FIG. 1 is a diagrammatic side elevational view of a suction belt conveyor table according to the invention during the infeeding of a first sheet to be processed.
FIG. 1*a* is a plot diagram depicting the vacuum pressure generated in the suction chamber by the first sheet during the infeed phase.

Referring now to the drawings and, first, particularly to FIG. 1 thereof, there is shown therein a conveyor table 1 which, together with two transport belts 2 which are arranged in parallel and revolve about the conveyor table 1, is located between a sheet pile 4 and aligning devices 6 in the form of front lays 7 and/or side lays 8.

The transport belts 2 are deflected by a deflection roller 9 and a belt drive roller 11, these rollers 9 and 11 having a gripping, for example, rubberized surface. The transport belts 2 have openings 12 (note FIG. 4) passing therethrough and a coated underside 3 having a low coefficient of friction. The exemplary embodiment described herein has two transport belts 2, as required for the sheet transport of large-format sheets. Of course, the invention can also be employed on a conveyor table 1 having only one transport belt 2, if correspondingly small sheet formats are to be processed.

Figure 4:
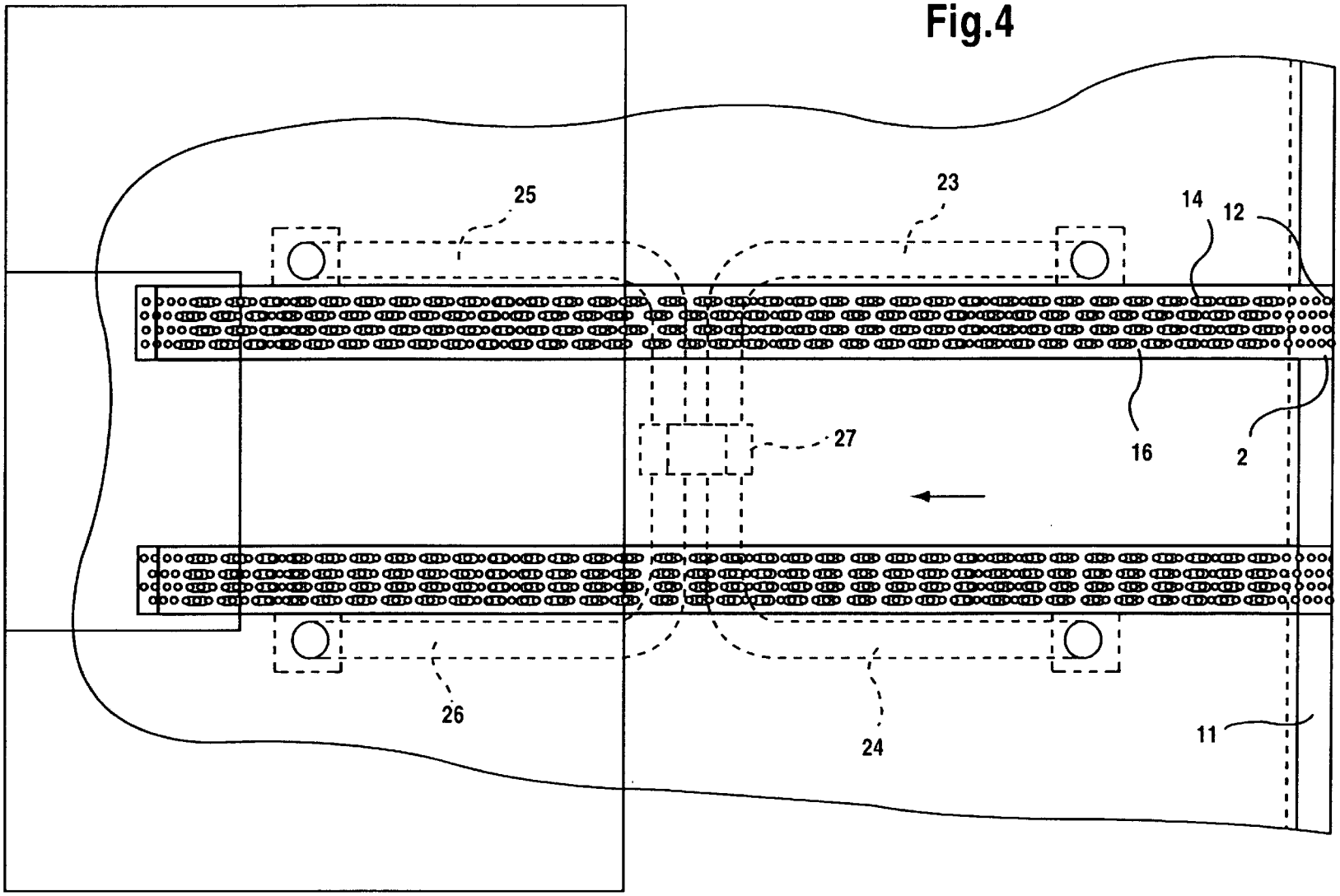
FIG. 4 is an enlarged fragmentary top plan view of FIG. 1, showing the suction belt conveyor table.

The openings 12 formed in the transport belts 2 are guided over the conveyor table 1, in the sheet transport direction represented by the unidentified arrow so that, as seen in FIG. 4, the openings 12 come into alignment with openings 14 on the upper side 16 of the conveyor table 1. The openings 12 and 14 connect the upper side of the transport belts 2 with a suction chamber 17 of a respective single-chamber suction box 18 disposed under the conveyor table 1. Each suction box 18 has two suction connections 19 and 21 which, as viewed in the sheet transport direction, are spaced apart from one another. A cross-sectional area A of the suction connection 19, 21 is exactly as large as a cross-sectional area B of the suction box 18.

A distance a of the rear suction connection 19, viewed as the first in the sheet transport direction, from a preceding conveying device in the form of the belt drive roller 11 which cooperates with a provided cycle roller 22 is equal to the smallest preselectable shingle length l (for example, 200 mm). A distance b of the front suction connection 21, viewed as the second in the sheet transport direction, from the front lays 7 corresponds at most to the length of the smallest format. The suction connections 19 and 21 are fitted in an outer side wall of the suction box 18 and are connected to a housing 27 by air hoses 23 to 26. A suction source in the form of a radial fan 28 is flanged on the housing 27. Arranged inside the housing 27 is a pivotally disposed air guide flap 29, which can be brought steplessly, i.e., continuously, from a first end position I into a second end position II.

To this end, a remotely controllable actuating element in the form of an operating cylinder 31 is provided, which engages by a piston rod 32 thereof with the air guide flap 29.

Initially, the air guide flap 29 is moved into the first end position I, so that the entire suction capacity of the radial fan 28 is switched to the rear suction connection 19. Then, a first sheet 33 is transported by the cycle roller 22 and the belt drive roller 11 cooperating therewith, in the sheet transport direction represented by the unidentified arrow, until the leading edge of the sheet 33 covers the suction connection 19. Consequently, in the region which is covered by the sheet 33, a vacuum is generated in the suction chamber 17 of the suction box 18, corresponding to the plot diagram shown in FIG. 1*a*. An effect thereof is that the first sheet 33 to be transported is already sucked reliably onto the transport belt 12.

Figures 2, 2A:
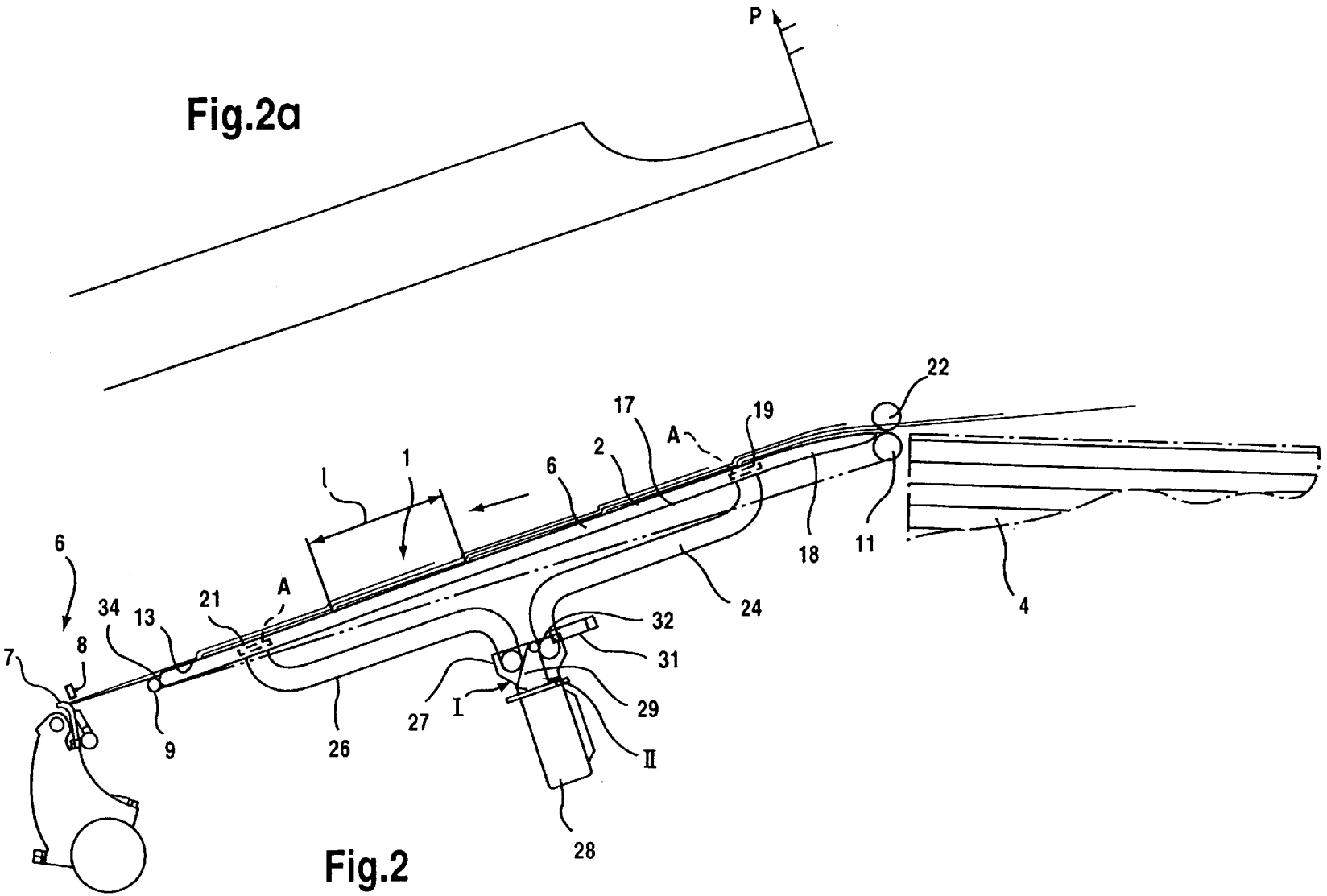
FIG. 2 is a view like that of FIG. 1 of the suction belt conveyor table fully covered with sheets.
FIG. 2*a* is a plot diagram like that of FIG. 1*a* for the conditions shown in FIG. 2.
Figure 3A:
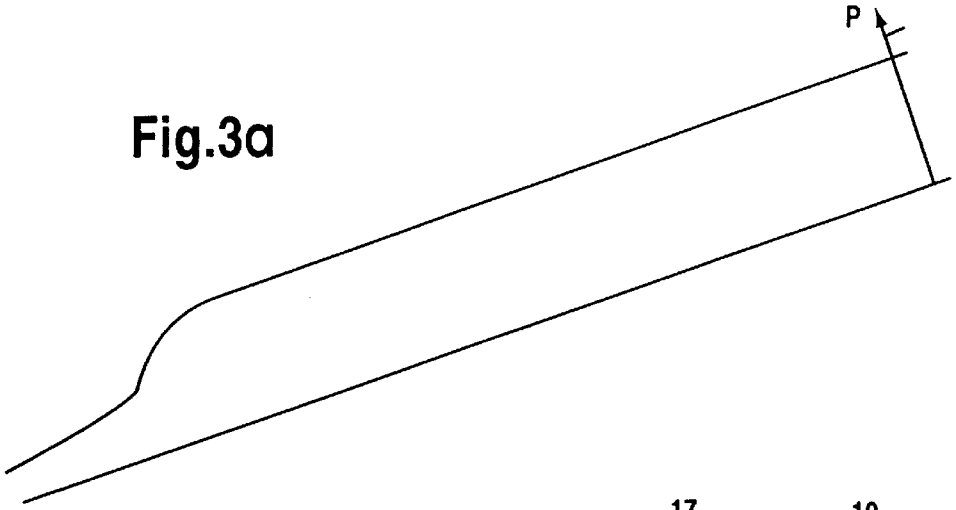
FIG. 3*a* is a plot diagram like those of FIGS. 1*a* and 2*a* for the conditions shown in FIG. 3.
Figure 3:
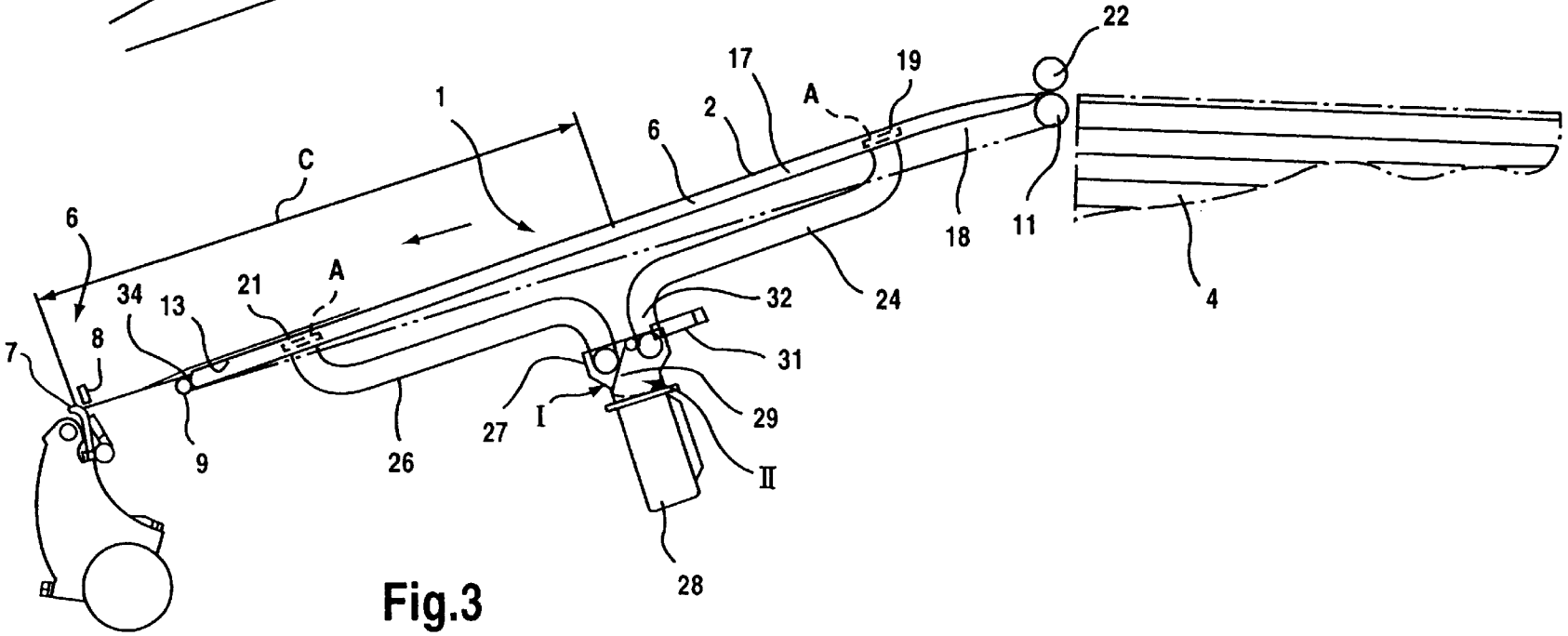
FIG. 3 is another view like that of FIG. 1 of the suction belt conveyor table showing a last sheet to be processed which is engaged with the front lays.

The second and the further sheets 13 are then continuously cyclically transported farther by the transport elements 11 and 22, until a conveyor stream is formed of sheets 33 arranged imbricated or shingled under one another, the sheet stream completely covering the conveyor table 1 and, accordingly, all of the openings 12 of the transport belt 2 which are located above the conveyor table 1. In this regard, a constant vacuum results in the entire suction chamber or space 17 of the suction box 18, as is illustrated in the plot diagram of FIG. 2*a*. The position of the air guide flap 29 can consequently assume both the first, as well as the second end position I, II. It is also possible for any other desired position between the end positions to be set steplessly or continuously.

Before the transport of the last sheet 23 to be processed, the air guide flap 29 is moved into the second end position II thereof. When the last sheet 33 strikes the front lays 7, the suction air source is switched off. Ambient air can then flow into the suction chamber or space 17 of the suction box 18, at the rear or trailing edge of the sheet 33. The effect thereof is that the suction force on the underside of the sheet 33 dwindles and remains effective only in a small region between the suction connection 21 and the starting location 34 of the suction box 18. Due to this measure, the sheet 33 may easily be aligned laterally relative to the transport direction thereof.

Figure 5A:
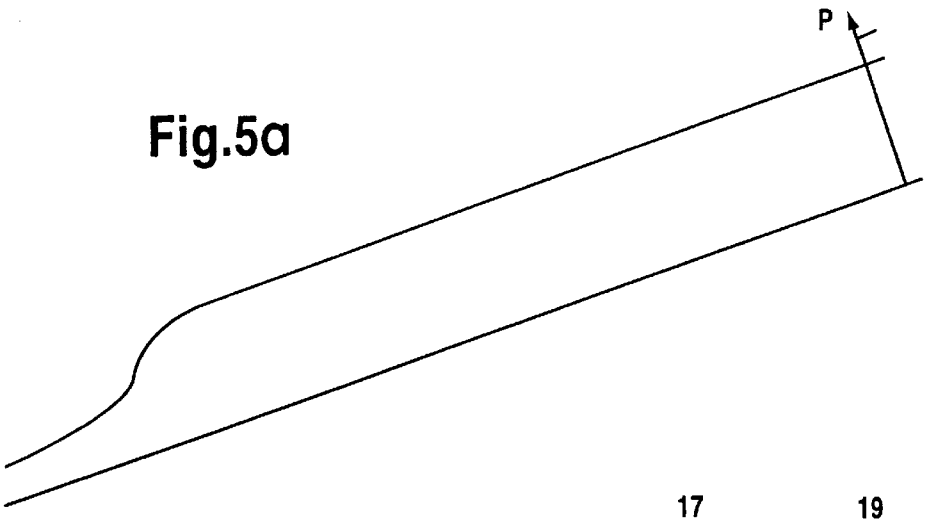
FIG. 5*a* is a plot diagram like those of FIGS. 1*a,* 2*a* and 3*a* for the conditions shown in FIG. 5.
Figure 5:
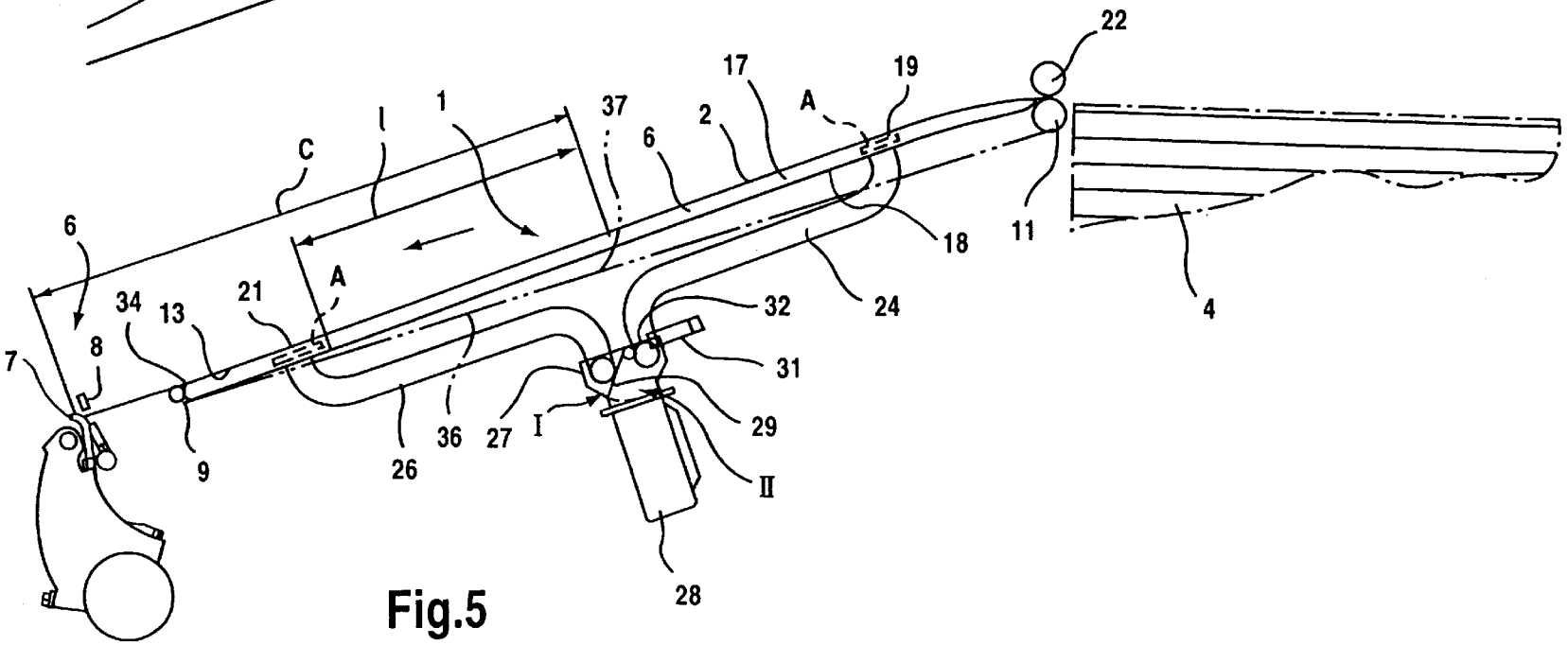
FIG. 5 is a view similar to that of FIG. 3 of a further exemplary embodiment of the suction belt conveyor table according to the invention.

In a second exemplary embodiment shown in FIG. 5, the suction box 18 is provided, in a front region thereof, with a variably adjustable suction chamber or space 17. In this regard, the bottom of the suction box 18 is constructed as a pivotable flap 36, the pivot being located in the region of the front suction opening 21. The flap 36 is given a length l so that a distance c between the front lays 7, on the one hand, and the end 37 of the flap 36 is greater than the greatest format length of the sheet 33 which is to be processed.

Pivoting the flap 36 results in an enlargement of the suction space in the front region and promotes the ventilation of the suction box 18 during the transport of the last sheet to be processed.

We claim:

1. A device for conveying an imbricated stream of sheets to a sheet processing machine, the device comprising:

a conveyor table formed with suction holes;

at least one endless transport belt formed with suction holes extending therethrough and being revolvingly drivable around said conveyor table;

at least one suction box disposed under said conveyor table and having a suction source applied thereto, said suction box communicating via said suction holes formed in said conveyor table with said suction holes formed in said transport belt, said suction box being assigned to said transport belt and being formed with a single suction chamber, said suction box having at least two suction connections spaced apart from one another, as viewed in a sheet transport direction, said suction chamber having a forward region, as viewed in the sheet transport direction, with a suction space having a larger volume than a remainder of said suction chamber.

2. The device as claimed in claim 1, wherein said suction box includes a pivotably mounted flap for varying the volume of the suction space.

3. The device as claimed in claim 2, wherein the suction space enlargement is disposed at a distance from front lays which is greater than the format length of a sheet to be processed.

4. The device as claimed in claim 1, including:

a valve disposed between said suction connections and said suction source, said valve being continuously moveable between two positions for varying communication between said suction connections and said suction source, communication between one of said suction connections and said suction source being varied inversely to communication between another one of said suction positions and said suction source as said valve is moved between said two positions.

5. The device as claimed in claim 1, including a controllable air guide flap disposed between said suction source and said suction connections.

6. The device as claimed in claim 1, wherein said suction box has a cross section corresponding to the cross section of one of said suction connections.

7. The device according to claim 1, including at least one sheet aligning device, and wherein a forward one of said suction connections, as viewed in the sheet transport direction, facing towards the sheet-processing machine, is arranged at a distance from said aligning device corresponding at most to the format length of the smallest sheet to be processed.

8. The device as claimed in claim 1, wherein one of said suction connections is a suction nozzle disposed in a rearward region, as viewed in the sheet transport direction, facing away from the sheet processing machine, said suction nozzle being located at a distance from a sheet pile corresponding to a smallest overlap or shingle length to be processed.

9. A device for conveying an imbricated stream of sheets to a sheet processing machine, the device comprising:

a conveyor table formed with suction holes;

at least one endless transport belt formed with suction holes extending therethrough and being revolvingly drivable around said conveyor table;

at least one suction box disposed under said conveyor table and having a suction source applied thereto, said suction box communicating via said suction holes formed in said conveyor table with said suction holes formed in said transport belt, said suction box being assigned to said transport belt and being formed with a single suction chamber, said suction box having at least two suction connections spaced apart from one another, as viewed in a sheet transport direction; and a valve disposed between said suction connections and said suction source, said valve moveable to a first position allowing only one of said suction connections to communicate with said suction source and moveable to a second position allowing only another one of said suction connections to communicate with said suction source.

* * * * *